US007850425B2

(12) United States Patent
Snook et al.

(10) Patent No.: US 7,850,425 B2
(45) Date of Patent: Dec. 14, 2010

(54) OUTER SIDEWALL RETENTION SCHEME FOR A SINGLET FIRST STAGE NOZZLE

(75) Inventors: Daniel D. Snook, Moore, SC (US); Edward D. Benjamin, Simpsonville, SC (US); Ariel K. Harter, Simpsonville, SC (US); David J. Humanchuk, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 795 days.

(21) Appl. No.: 11/836,865

(22) Filed: Aug. 10, 2007

(65) Prior Publication Data

US 2009/0038311 A1 Feb. 12, 2009

(51) Int. Cl.
*F01D 9/02* (2006.01)

(52) U.S. Cl. ..... 415/209.3; 415/213.1; 415/191; 415/211.2

(58) Field of Classification Search ..... 415/209.2, 415/209.3, 213.1, 191, 211.2
See application file for complete search history.

(56) References Cited

U.S. PATENT DOCUMENTS 5,176,496 A 1/1993 Correia et al.
5,271,714 A * 12/1993 Shepherd et al. ..... 415/209.2
5,459,995 A 10/1995 Norton et al.
5,591,003 A * 1/1997 Boyd et al. ..... 415/209.2
5,634,768 A * 6/1997 Shaffer et al. ..... 415/137
6,537,023 B1 3/2003 Aksit et al.
6,572,331 B1 * 6/2003 Mohammed-Fakir et al. .... 415/191
7,037,071 B2 * 5/2006 Antunes et al. ..... 415/189

* cited by examiner

*Primary Examiner*—Ninh H Nguyen
(74) *Attorney, Agent, or Firm*—Edward J. Smith; Ernest G. Cusick; Frank A. Landgraff

(57) ABSTRACT

An outer sidewall retention scheme for a singlet first stage nozzle of a gas turbine. The retention scheme includes a circumferential retaining ring with a main body and a pair of circumferential retaining lands projecting inward radially. A circumferential annular retaining groove is formed between the pair of circumferential retaining lands. A first lug and a second lug mounted on an outer face of the outer sidewall of each nozzle are adapted to fit within the circumferential annular retaining groove of the retaining ring and are supported radially and circumferentially by a first retaining pin and a second retaining pin, each pin passing though the circumferential retaining lands. Each nozzle further includes a chordal hinge rail and seal on the outer sidewall and a chordal hinge rail and seal on the inner sidewall providing axial support for the nozzle.

20 Claims, 10 Drawing Sheets

OUTER SIDEWALL RETENTION SCHEME FOR A SINGLET FIRST STAGE NOZZLE

BACKGROUND OF THE INVENTION

The invention relates generally to an arrangement for mounting gas turbine nozzles and more specifically to an outer sidewall retention scheme for a singlet first stage nozzle.

In a gas turbine, hot gases of combustion flow from combustors through first-stage nozzles and buckets and through the nozzles and buckets of follow-on turbine stages. The first-stage nozzles typically include an annular array or assemblage of cast nozzle segments each containing one or more nozzle stator vanes per segment. Each first-stage nozzle segment also includes inner and outer sidewall portions spaced radially from one another. Upon assembly of the nozzle segments, the stator vanes are circumferentially spaced from one another to form an annular array thereof between annular inner and outer sidewalls. A nozzle retaining ring coupled to the outer sidewall of the first-stage nozzles supports the first-stage nozzles in the gas flow path of the turbine. An annular nozzle support ring, preferably split at a horizontal midline, is engaged by the inner sidewall and may support the first-stage nozzles against axial movement.

Side seals may seal the annular array of segments one to the other along adjoining circumferential edges. The side seals seal between a high pressure region radially inwardly of the inner sidewall and radially outward of the outer sidewall, i.e., compressor discharge air at high pressure, and the hot gases of combustion in the hot gas flow path which are at a lower pressure. Chordal hinge seals are used to seal between the inner sidewall of the first-stage nozzles and an axially facing surface of the nozzle support ring and between the outer sidewall and a shroud for the first stage bucket.

Referring now to FIG. 1, there is illustrated a representative example of a generalized turbine section of a gas turbine, designated 10. Turbine 10 receives hot gases of combustion from an annular array of combustors, not shown, which transmit the hot gases through a transition piece 12 for flow along an annular hot gas path 14. Turbine stages are disposed along the hot gas path 14. Each stage comprises a plurality of circumferentially spaced buckets mounted on and forming part of the turbine rotor and a plurality of circumferentially spaced stator vanes forming an annular array of nozzles. For example, the first stage includes a plurality of circumferentially-spaced buckets 16 mounted on a first-stage rotor wheel 18 and a plurality of circumferentially-spaced stator vanes 20. Similarly, the second stage includes a plurality of buckets 22 mounted on a rotor wheel 24 and a plurality of circumferentially-spaced stator vanes 26. Additional stages may be provided, for example, a third stage comprised of a plurality of circumferentially-spaced buckets 28 mounted on a third-stage rotor wheel 30 and a plurality of circumferentially-spaced stator vanes 32. It will be appreciated that the stator vanes 20, 26 and 32 are mounted on and fixed to a turbine casing, while the buckets 16, 22 and 28 and wheels 18, 24 and 30 form part of the turbine rotor. Between the rotor wheels are spacers 34 and 36, which also form part of the turbine rotor. It will be appreciated that compressor discharge air is located in a region 37 disposed radially inwardly and radially outward of the first stage and that such air in region 37 is at a higher pressure than the pressure of the hot gases flowing along the hot gas path 14.

Referring to the first stage of the turbine, the stator vanes 20 forming the first-stage nozzles are disposed between inner and outer sidewalls 38 and 40, respectively, supported from the turbine casing. As noted above, the nozzles of the first stage are formed of a plurality of nozzle segments each mounting one, or two, stator vanes extending between inner and outer sidewall portions and arranged in an annular array of segments. A nozzle retaining ring 42 connected to the turbine casing is coupled to the outer sidewall and secures the first-stage nozzle. A nozzle support ring 44 radially inwardly of the inner sidewall 38 of the first-stage nozzles engages the inner sidewall 38. Particularly, the interface between the inner sidewall 38 and the nozzle support ring 44 includes an inner rail 52. The inner rail 52 includes a chord-wise, linearly extending axial projection, generally and collectively hereinafter referred to as a chordal hinge seal. It will be appreciated that high pressure compressor discharge air lies in the region 37 and lower pressure hot gases flowing in the hot gas path 14 lay on the opposite side of the chordal hinge seal. The chordal hinge seal is thus intended to seal against leakage from the high pressure region 37 into the lower pressure region of the hot gas path 14.

A nozzle comprises a plurality of radially extending airfoils arranged circumferentially about an engine axis, the airfoils being supported by radially inner and outer circumferential sidewalls. Either the inner or outer sidewalls may include some form of flange for coupling the nozzle to a stationary engine mounting structure. In general, a plurality of turbine nozzles is interleaved with a plurality of turbine rotor stages. The directing process performed by the nozzles also accelerates gas flow resulting in a static pressure reduction between inlet and outlet planes and high pressure loading of the nozzles. Additionally, the nozzles experience high thermal gradients from the hot combustion gases and the coolant air at the radial mounting surfaces.

The use of bolts and clamps at circumferential locations about a nozzle sidewall act as a restriction to the sidewall, which sidewall is hotter than the structure to which it is attached, causing radial bowing of the outer sidewall of the nozzle and stressing of the airfoils attached to the sidewall. Such stressing of the airfoils may lead to formation of cracks in the airfoil trailing edge.

FIG. 2 illustrates in greater detail a prior art sidewall retention system 100 for a first stage nozzle 110. The first stage nozzle 110 includes an outer sidewall 115, an inner sidewall 120 and an airfoil 125 positioned between a nozzle retaining ring 130 and a nozzle support ring 135. The nozzle retaining ring 130 and the support ring 135 are attached to the casing of the turbine (not shown). The first stage nozzle also includes chordal hinge rails for the inner sidewall and outer sidewall. The chordal hinge rail 145 on the inner sidewall 120 provides axial support for the nozzle 110 against the support ring 135 and the chordal hinge rail 150 provides axial support for the nozzle 110 against the shroud 160 of the first stage bucket 170. The inner chordal hinge rail 145 and outer chordal hinge rail 150 further provide chordal hinge seals 147, 152.

The chordal hinge rail 150 on the outer sidewall 115 of the nozzle 110 projects outward radially from the outer sidewall 115. The chordal hinge rail 150 incorporates a forward-facing annular retaining land 175 at its outermost radial projection. The retaining land 175 mates with an aft-facing annular groove 180 established by an aft-facing retaining hook 185 on the retaining ring. The retaining land 175 of the chordal hinge rail 150 acting on the retaining hook 185 of the retaining ring 130 provides radial support for the nozzle 110. The annular retaining hook 185 may be divided into segments (not shown). Circumferential support is provided by an anti-rotation pin (not shown) that passes through the retaining ring 130 and the retaining land 175.

Power generation gas turbines traditionally use some type of hook retention scheme. Improvements have been made on the traditional hook retention scheme by changing from a continuous hook arrangement, typical in FA class machines by GE to a segmented hook arrangement, typical in FB class machines by GE. This change resulted in more determinate nozzle loading and better nozzle sealing but also resulted in less than optimal thermal isolation of the retaining ring and thereby a substantial cost increase to the nozzle arrangement. Some of the field issues related to hook retention designs include incomplete chordal hinge sealing, retaining ring out of roundness, and high trailing edge stresses.

Accordingly, there is a need to provide determinate nozzle loading and improved sealing while also improving thermal isolation of the retaining ring, reducing cost, and improving assembly flexibility of the nozzle arrangement.

BRIEF DESCRIPTION OF THE INVENTION

The present invention relates to an apparatus and method for retaining the outer sidewall of a singlet first stage nozzle in a gas turbine.

Briefly in accordance with one aspect of the present invention, an outer sidewall retention scheme for a first stage singlet nozzle of a gas turbine is provided. The retention scheme includes a circumferential retaining ring. The retaining ring incorporates a main body and a pair of circumferential retaining lands projecting inward radially from the main body of the retaining ring. The pair of circumferential retaining lands may be separated from each other by a predetermined distance. A circumferential annular retaining groove is formed between the pair of circumferential retaining lands with the groove having a width of the predetermined distance between the pair of circumferential retaining lands.

A first stage nozzle including an inner sidewall and an outer sidewall may be assembled on the retaining ring. A first lug and a second lug may be mounted on an outer face of the outer sidewall of each nozzle. The first lug and the second lug are adapted to fit within the circumferential annular retaining groove of the retaining ring. A first retaining pin is provided for attaching the first lug within the circumferential annular retaining groove to the pair of circumferential retaining lands and a second retaining pin is provided for attaching the second lug within the circumferential annular retaining groove to the circumferential retaining lands. Two chordal hinges rails may be provided for the nozzle. One chordal hinge rail is mounted on the outer sidewall for each nozzle. A chordal hinge rail is also provided on the inner sidewall for each nozzle.

In accordance with a second aspect of the present invention, a method is provided for retaining a first stage singlet nozzle in a first stage of a gas turbine. The gas turbine will include a first stage retaining ring with a pair of parallel circumferential retaining lands and a groove in-between, a nozzle including an outer sidewall with a first lug, a second lug and a chordal hinge rail, and an inner sidewall with a chordal hinge rail.

The method includes providing radial and circumferential support for the nozzle with an outer sidewall retention scheme by pinning the first lug to the pair of circumferential retaining lands and pinning the second lug to the pair of circumferential retaining lands. Axial support for the nozzle is provided by a chordal hinge rail on the outer sidewall and a chordal hinge rail on the inner sidewall.

According to a third aspect of the present invention, a gas turbine employing a sidewall retention scheme for a first stage singlet nozzle is provided. The retention scheme includes a circumferential retaining ring. The retaining ring incorporates a main body and a pair of circumferential retaining lands projecting inward radially from the main body of the retaining ring. The pair of circumferential retaining lands may be separated from each other by a predetermined distance. A circumferential annular retaining groove is formed between the pair of circumferential retaining lands with the groove having a width of the predetermined distance between the pair of circumferential lands.

A first stage nozzle including an inner sidewall and an outer sidewall are provided. The outer sidewall may be skewed off an axial direction of the retaining ring. A first lug and a second lug mounted on an outer face of the outer sidewall of each nozzle are adapted to fit within the circumferential annular retaining groove of the retaining ring. A plurality of retaining pins, including a first retaining pin and a second retaining pin for each of the plurality of first stage nozzles is included. A first retaining pin is adapted for attaching the first lug within the circumferential annular retaining groove to the pair of circumferential retaining lands. A second retaining pin is adapted for attaching the second lug within the circumferential annular retaining groove to the circumferential retaining lands. Each nozzle further includes a chordal hinge rail on the outer sidewall and a chordal hinge rail on the inner sidewall.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
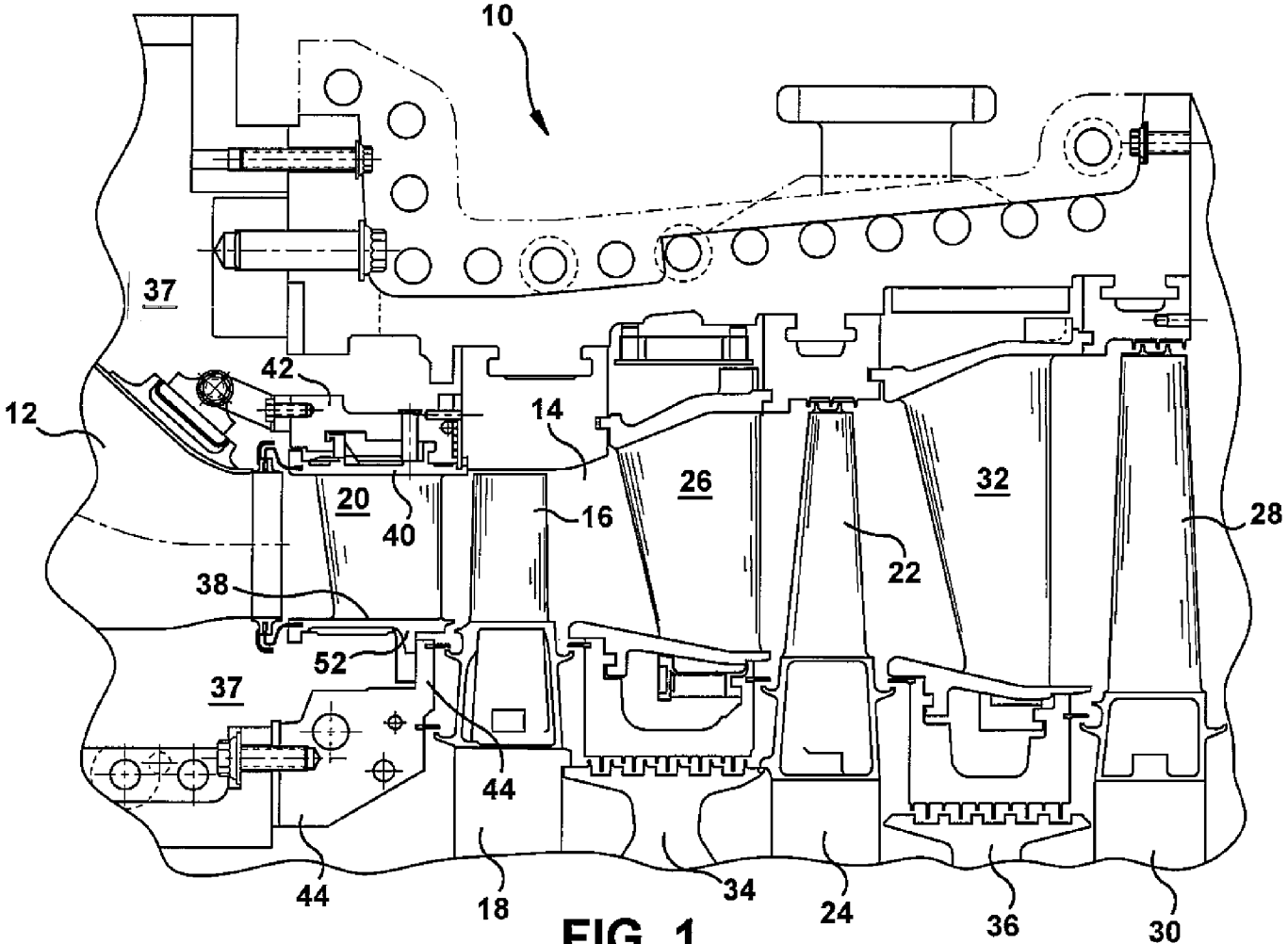
FIG. 1 (Prior Art)
FIG. 1 is a fragmentary schematic side elevational view of a portion of a typical prior art gas turbine.
Figure 2:
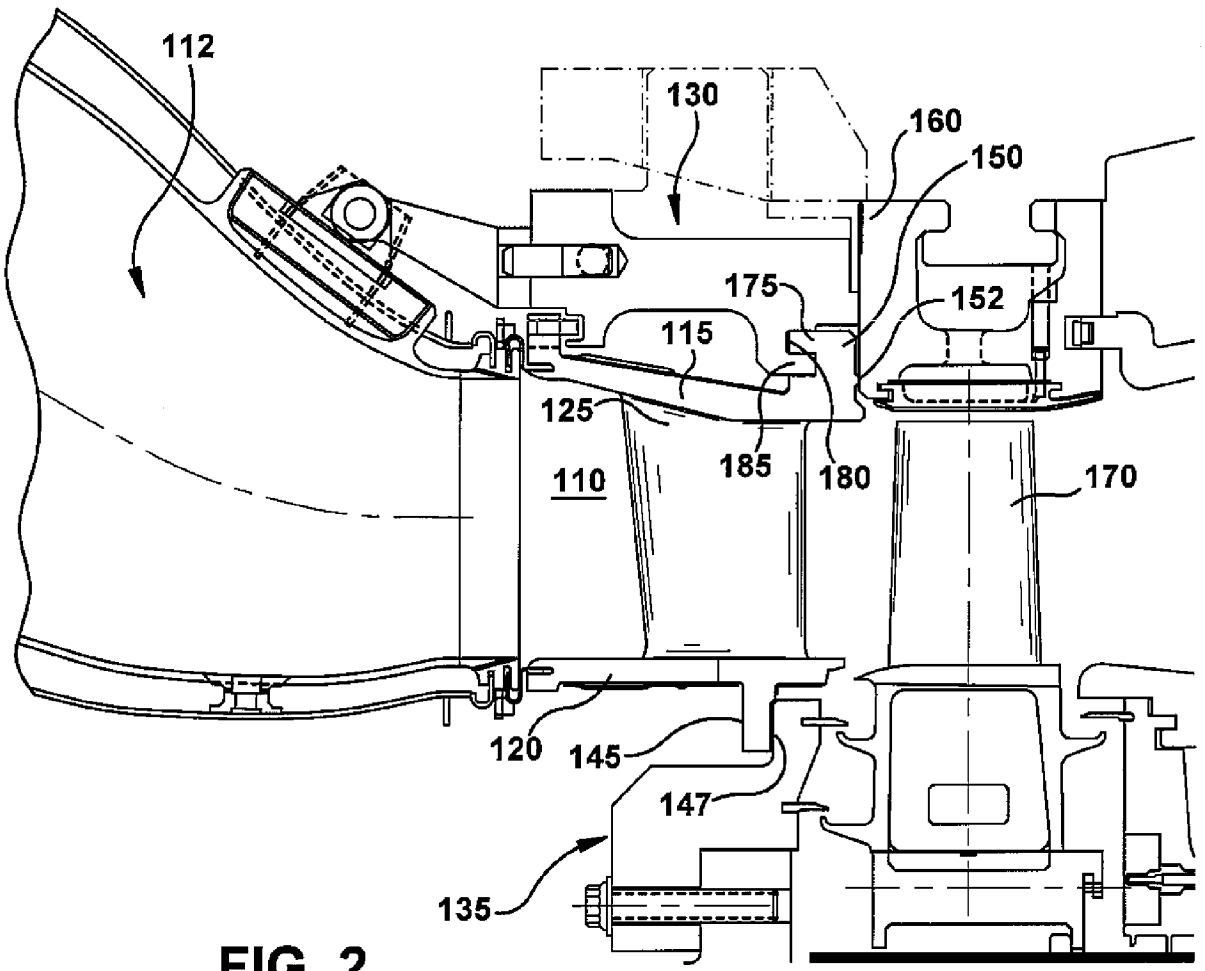
FIG. 2 (Prior Art)
FIG. 2 illustrates a typical sidewall retention scheme first stage nozzle employing a hook retention scheme for the outer sidewall in a prior art gas turbine.

The following embodiments of the present invention have many advantages, including improved nozzle stability, determinate nozzle loading, airfoil trailing edge stress reduction, improved retaining ring thermal isolation, improved nozzle arrangement assembly flexibility, improved chordal hinge sealing, and improved nozzle castibility.

Power generation gas turbines traditionally use a hook retention scheme. Hook retention schemes inherently have several design drawbacks that cannot be overcome. The present invention overcomes the drawbacks of the hook design. An embodiment of the inventive design retains the first stage nozzle with two axially oriented pins. The benefits of this retention scheme include improved nozzle stability, determinate nozzle loading, airfoil trailing edge stress reduction, improved retaining ring thermal isolation, improved nozzle arrangement assembly flexibility, improved chordal hinge sealing, and improved nozzle castibility.

More specifically, the first stage nozzle is attached to the retaining ring at the outer sidewall with two axially oriented pins. Both pins are supported on each end in axially oriented pinholes in the retaining ring thereby being simply supported. One pin passes through a pinhole in a nozzle lug. A second pin passes through a slot in a nozzle lug. The slot is open to the pressure side of the nozzle. The first pin prevents the nozzle from translating in the radial and tangential directions. The second pin prevents the nozzle from rotating about the axial direction. Combined with the inner sidewall and outer sidewall chordal hinge rails, the result is a fully constrained, non-redundant retention system. The lugs are positioned in such a way as to maximize nozzle stability, minimize stress input into life limiting features, i.e. the trailing edge, and to guarantee deterministic nozzle loads. The nozzle stability is maximized by moving the lugs as far forward as possible and as far apart as possible to generate longer moment arms for reacting out gas loads. Moving the support lugs away from the trailing edge minimizes the stress input into the trailing edge. The nozzle loads are made more deterministic by designing the retention features to only be capable of supporting loads in the designated directions. The inventive retention scheme also drastically reduces thermal input from the nozzle into the retention features in comparison to the original hook design. Minimizing the contact area and preventing dead cavities between the nozzle and the retention features accomplish this reduction. The inventive retention scheme is designed for ease of assembly and manufacturing.

The improved retention scheme results in improved nozzle and retaining ring life, leakage reduction resulting in nitrogen oxide (Nox) reduction, and substantially lower nozzle arrangement cost relative to comparable technology engines.

The outer sidewall retention scheme for first stage singlet nozzles includes a circumferential retaining ring with a circumferential annular groove, a plurality of first stage nozzles each with an inner sidewall and an outer sidewall, a first lug and a second lug mounted on the outer sidewall of each nozzle, a first retaining pin and a second retaining pin, and a chordal hinge rail on the each sidewall for each nozzle.

Figure 3A:
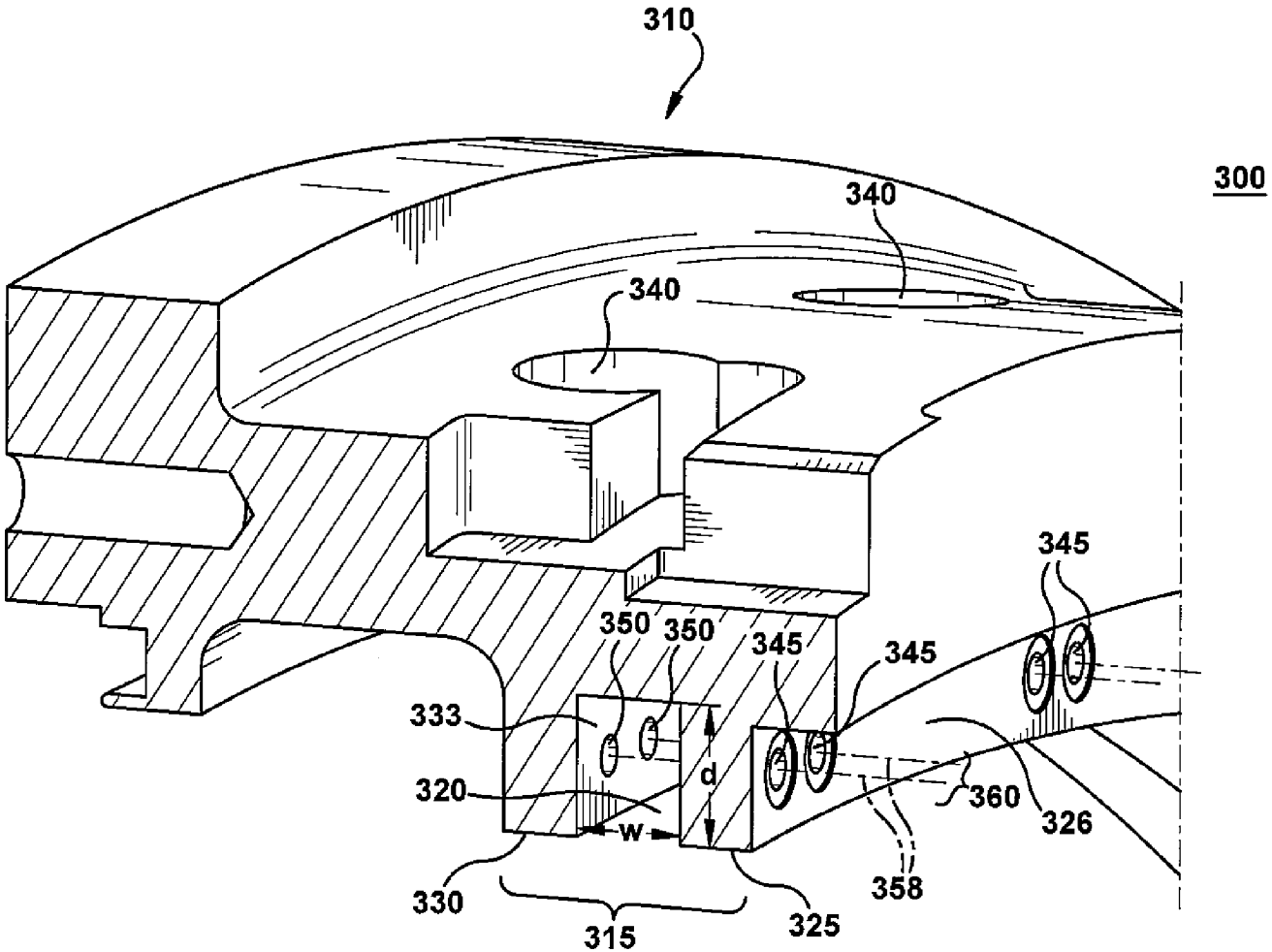
FIG. 3A and FIG. 3B illustrate an embodiment of an inventive retaining ring for the outer sidewall retention scheme.
Figure 3B:
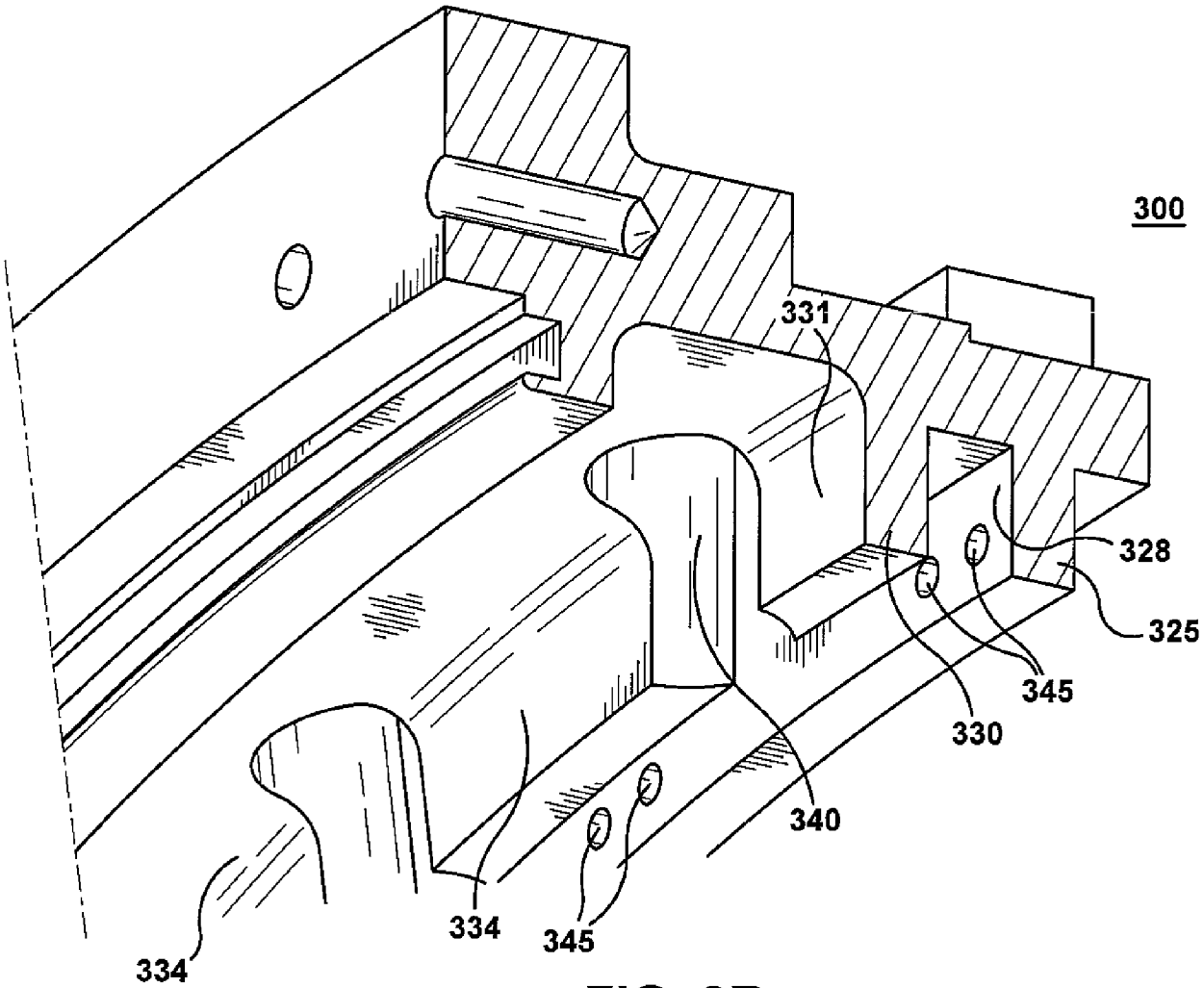

FIGS. 3A and 3B illustrate an isometric cross section of an embodiment of the retaining ring from an aft and a forward perspective, respectively. The retaining ring 300 includes a main body 310 of a generally cylindrical shape that is supported by the casing of the turbine by methods known in the art. Although not shown, the retaining ring is preferentially divided into two semi-circular rings to facilitate assembly. The main body 310 may include a pair of circumferential retaining lands 315 projecting inward radially from the main body 310. The pair of circumferential lands may be located on the aft side of retaining ring 300, each land being separated from each other axially by a predetermined distance w. The projection d from the main body 310 and the predetermined width w between the pair of circumferential lands 315 define a circumferential annular groove 320. The pair of circumferential retaining lands 315 may include an aft retaining land 325 and a forward retaining land 330. The aft retaining land 325 includes an aft circumferential face 326 and a forward circumferential face 328. The forward retaining land 330 includes an forward circumferential face 331 and an aft circumferential face 333. The forward retaining land 330 may optionally be interrupted along its circumferential length by a plurality of radial oriented cooling holes 340, thereby creating circumferential segments 334 in the forward retaining land 330. The cooling holes 340 provide a path for cooling air from outside the main body 310 of the retaining ring and meshing with an internal channel within the airfoil of the nozzle to cool the nozzle.

A plurality of axial-oriented through-holes 345 are provided between the aft circumferential face 326 and the forward circumferential face 328 of the aft retaining land 325. A plurality of axial-oriented closed-end bore holes 350 are provided through the aft face 333 of forward retaining land 330. The plurality of axial-oriented through-holes 345 in the aft retaining land 325 and the plurality of axial-oriented closed-end bore holes 350 in the forward retaining land 330 are radially and circumferentially organized coaxially to accept a retaining pin (not shown) axially through the aft retaining land 325 and into the bore hole 350 of the forward retaining land 330. The coaxially oriented holes with centerline 358 are further arranged circumferentially in pairs, equally spaced around the retaining lands. The circumferential arrangement of the paired holes 360, being key to the positive capture scheme of the retaining pins, will later be described in greater detail. The diameter of the paired holes 360 are sized to accept retaining pins for the nozzle.

Figure 4A:
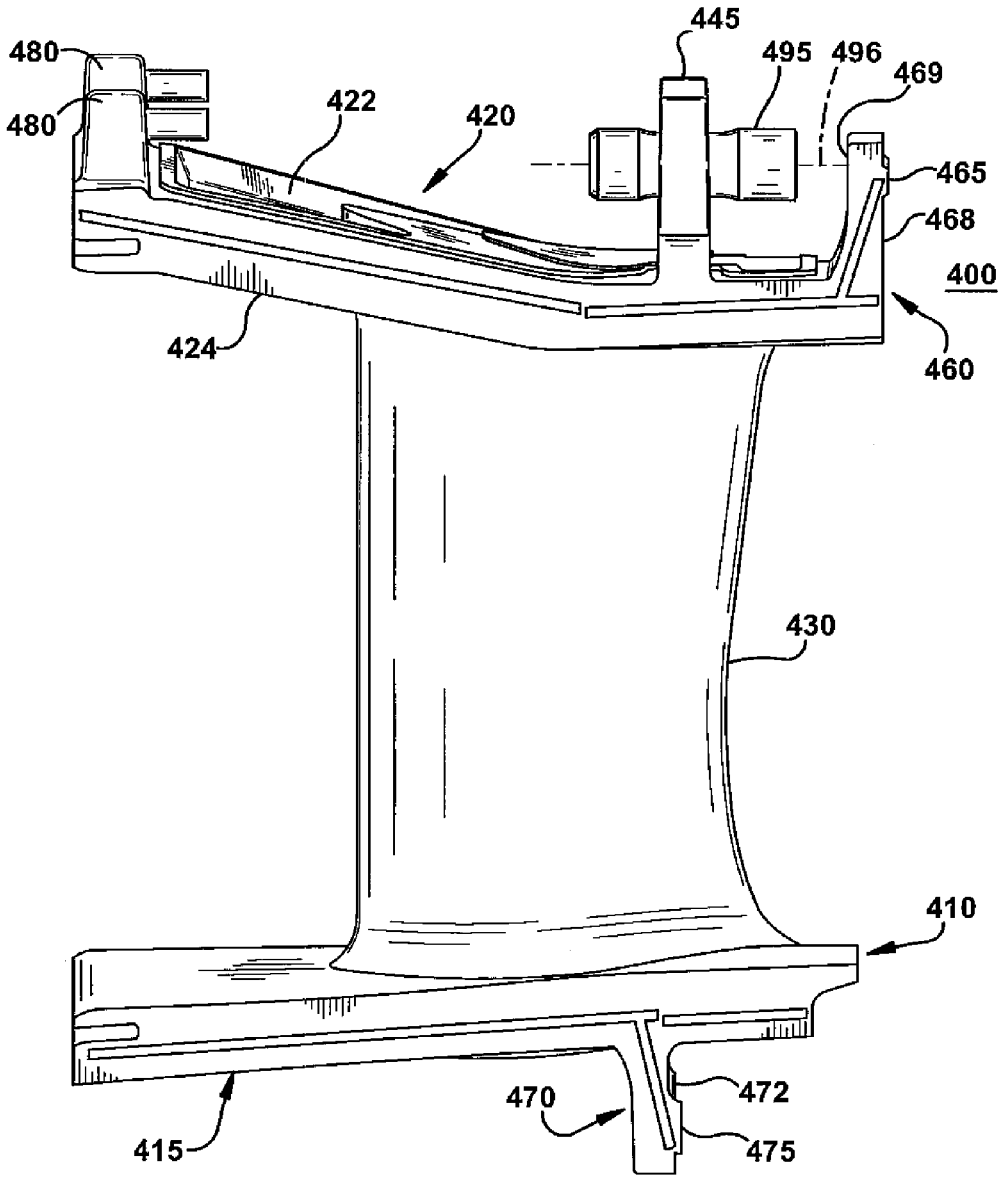
FIGS. 4A, 4B and 4C illustrates views of an embodiment of an inventive singlet first stage nozzle for the outer sidewall retention scheme.
Figure 4B:
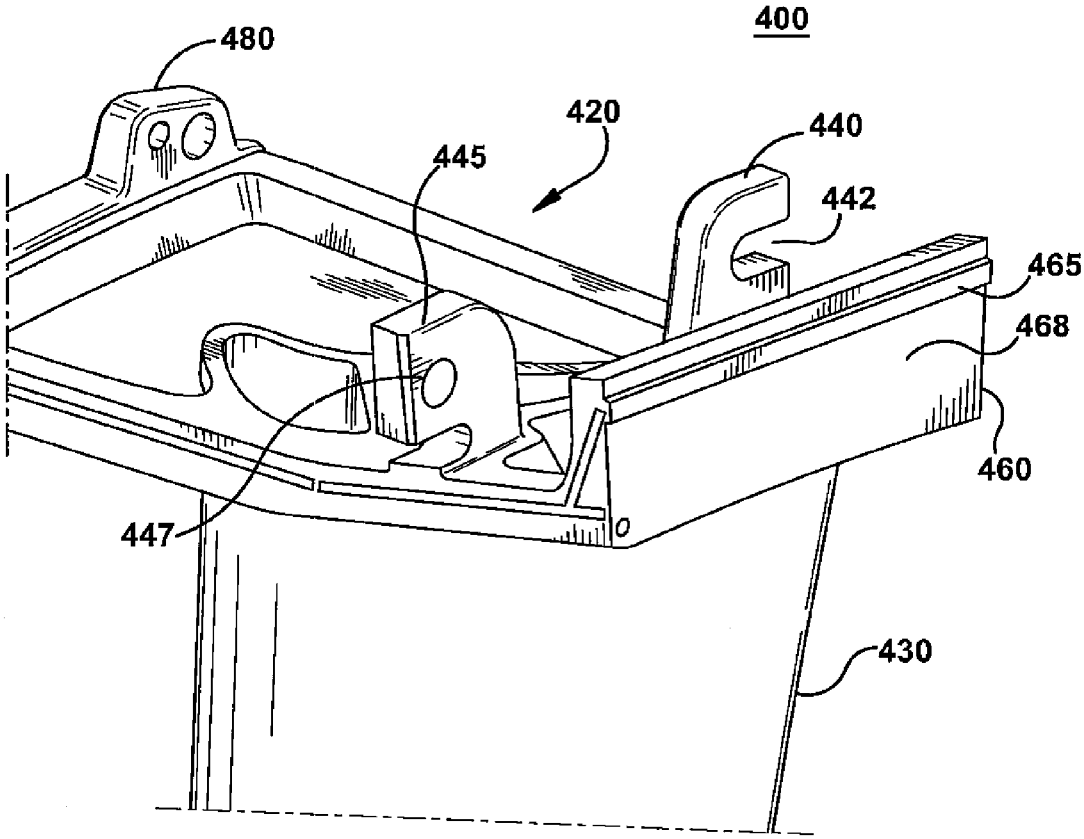
Figure 4C:
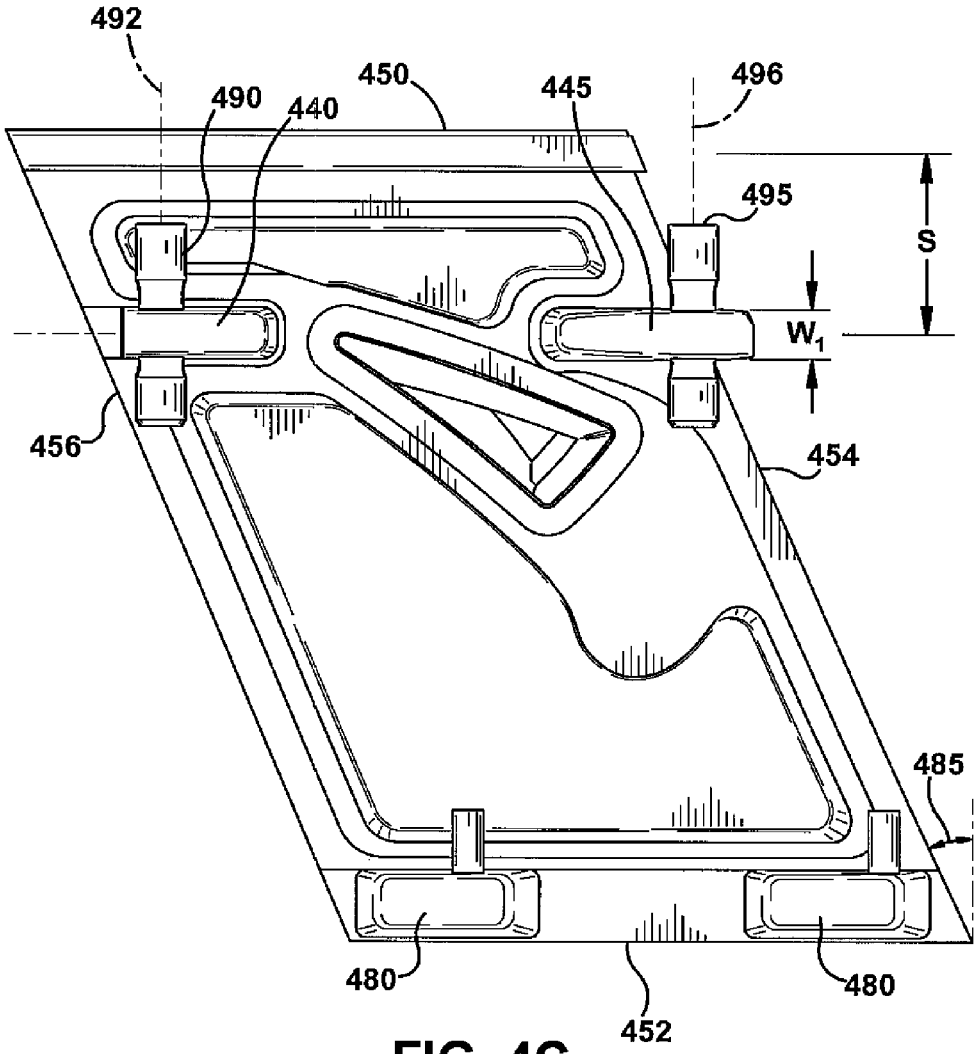

FIG. 4A illustrates a side view of an embodiment of a first stage nozzle in the outer sidewall retention scheme. FIG. 4B illustrates an isometric view of an outer surface of the outer sidewall of the first stage nozzle. FIG. 4C illustrates a top view of the outer surface of the outer sidewall of the first stage nozzle.

The first stage nozzle 400 includes an inner sidewall 410, an outer sidewall 420 and an airfoil 430 in-between. The airfoil 430 may include an internal cavity for nozzle cooling having an entrance aligned generally in axial and circumferential alignment with the air-cooling hole (FIG. 3B, 340) of the retaining ring. The outer sidewall 420 includes an outer face 422 and an inner face 424. With respect to orientation of the four sides of the nozzle sidewall, when in place on the retaining ring, an aft side is the upstream side and a forward side is the downstream side with respect to flow through the turbine. Further, the pressure side is the clockwise side and the suction side is the counterclockwise side when looking down the flow path from the combustor end.

The outer face 422 of the outer sidewall 420 includes two retaining lugs. A first lug 440 and a second lug 445 are positioned forward from the aft edge 450 of the sidewall by a predetermined distance s, the lugs being in axial alignment with respect to the aft end of the sidewall. The first lug 440 is positioned on the pressure side 456 of the sidewall. The second lug 445 is positioned on the suction side 454 of the sidewall. The first lug 440 and the second lug 445 may be circumferentially positioned in proximity to the edge of their respective edge of the outer sidewall 420. The first lug 440 and the second lug 445 include a width $w_1$. $W_1$ is adapted to fit within the circumferential retaining groove (FIG. 3A, 320) of the pair of retaining lands when the nozzle is mounted on the retaining ring. The first lug 440 includes an axial oriented open-ended slot 442. The second lug 445 includes an axial-oriented closed pinhole 447. The closed pinhole 447 and the open-ended slot 442 are centered to align radially and circumferentially with the centerline (FIG. 3A, 358) of the axially oriented paired holes (FIG. 3A, 360) in the retaining lands when the nozzle is mounted on the retaining ring (FIG. 3A, 300). The closed pinhole 447 and the open slot 442 are sized to accept retaining pins for the nozzle. The nozzle stability is maximized by placement of the lugs as far forward as possible and as far apart as possible to generate longer moment arms for reacting out gas loads. Moving the support lugs away from the trailing edge minimizes the stress input into the trailing edge.

The outer sidewall 420 further includes a chordal hinge rail 460 on the aft edge 450. The chordal hinge rail 460 runs from the inner face of the sidewall from the pressure side to the suction side and extends in a generally outward radial direction from the aft edge 450 of sidewall. The chordal hinge rail 460 projects sufficiently outward radially to cover at least partially or fully the radial reach of the through-holes (FIG. 3A, 345) in the aft face of the aft retaining land. A chordal hinge seal 465 is provided on the aft surface 468 of the chordal hinge rail 460 for providing a seating surface against the shroud for first stage bucket. The chordal hinge seal 465 also provides axial support for the outer sidewall against the shroud. The axial support by the shroud for the outer sidewall complements radial and circumferential support provided by the retaining lands.

Referring to FIG. 4C, the top view of the outer sidewall illustrates that the sidewall carries the shape of a parallelogram with an sidewall skew angle 485 of about 23 degrees from the axial direction. The skewing results in the aft end 450 of the outer sidewall 420 (and hence the chordal hinge rail 460) being shifted circumferentially towards the pressure side 456 and away from the suction side 454 of the outer sidewall 420. With the first retaining pin 490 in place in first retaining lug 440, axial insertion and removal along centerline line 492 of the first retaining pin 490 is thus blocked by chordal hinge rail 460. However, centerline 496 of second retaining pin 495 in second retaining lug 445 falls circumferentially outside chordal hinge rail 460.

The inner sidewall 410 further includes a chordal hinge rail 470 on an inner face. The chordal hinge rail 470 runs across the inner face 415 of the inner sidewall 410 from the pressure side to the suction side and extends in a generally inward radial direction from the inner face 415 of the inner sidewall 410. The chordal hinge rail 470 includes the raised seating surface of a chordal hinge seal 475 that seats with an inner support ring to provide axial support for the inner sidewall of the nozzle. The chordal hinge seal 475 further blocks against passage of high-pressure air from the compressor between the inner sidewall and the inner support ring.

Figure 5:
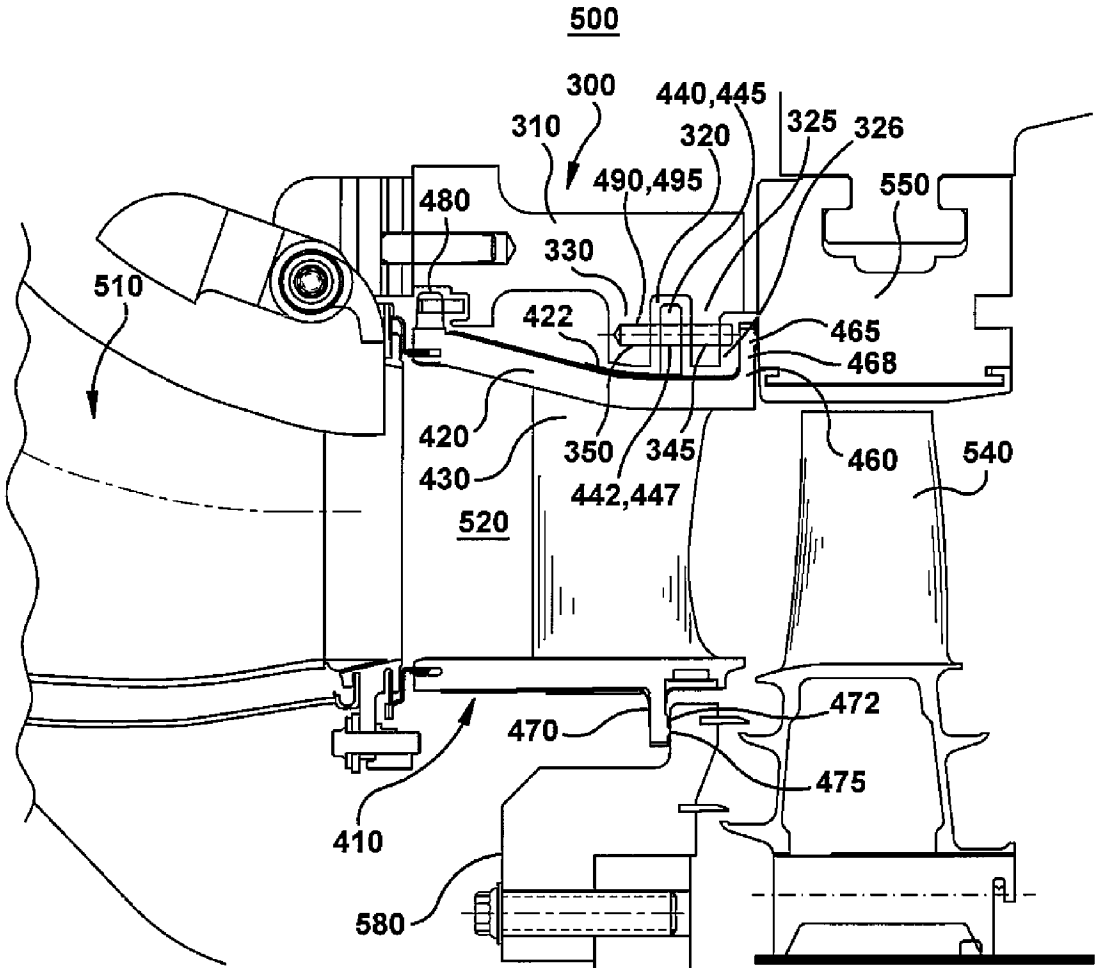
FIG. 5 illustrates a schematic side elevational view of the outer sidewall retention scheme.

FIG. 5 illustrates a schematic side elevational view of the outer sidewall retention scheme 500 for a first stage nozzle. Hot gases of combustion flow from a combustor (not shown) through transition piece 510. The hot gases enter the first stage nozzle 520, impinging on airfoil 430. The hot gases are directed by the airfoil 430 to the first stage bucket 540. The directing process performed by the nozzles also accelerates gas flow resulting in a static pressure reduction between inlet and outlet planes and high pressure loading of the nozzles. Retaining ring 300 includes forward circumferential land 330 and aft circumferential land 325. Retaining lugs 440, 445 (one shown) of the outer sidewall 420 for each first stage nozzle fit into annular groove 320. Retaining pins 490, 495 (one shown) fit through axial holes 345 and 350 in the aft retaining land 325 and the forward retaining land 330, respectively. The retaining pins 490, 495 provide radial and circumferential support for the first stage nozzle 520 through retaining lugs 440, 445. Chordal hinge rail 460 on the outer sidewall 420 provides axial support for the nozzle at the point of the chordal hinge seal 465 making contact with the shroud 550 for the first stage bucket 540. Chordal hinge rail 470 on the inner sidewall 410 provides axial support for the nozzle at the point of chordal hinge seal 475 making contact with the support ring 580. Retaining pins 490, 495 (one shown) are prevented from backing out from the retaining lugs 530 by chordal hinge rail 460.

As previously described, axially oriented holes for retaining pins are arranged circumferentially in pairs, equally spaced around the aft retaining land of the retaining ring. The first stage nozzles may be assembled on the retaining ring as illustrated in FIGS. 6A-6G.

Figure 6A:
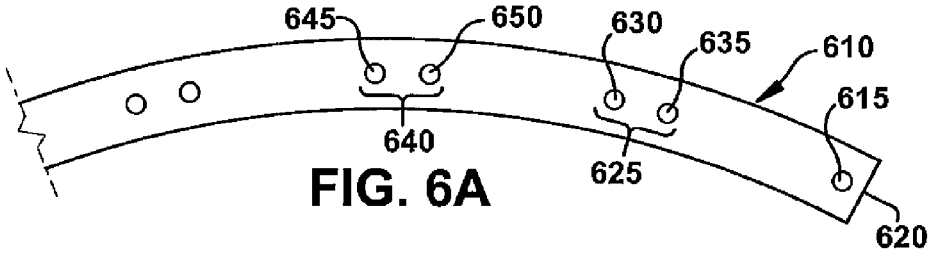
FIGS. 6A-6G illustrate a method for installing first stage nozzles to a retaining ring.

FIG. 6A illustrates a view from the aft side of an arrangement of the holes for retaining pins to hold the lugs of the outer sidewall of a first stage nozzle to the retaining lands of the retaining ring. The holes, as previously described, are arranged in pairs. Each pair of holes (625, 640) includes a first retaining hole (630, 645) and a second retaining hole (635, 650). The first retaining hole (630) accommodates a first retaining lug for the outer sidewall of a first stage nozzle being installed. The second retaining hole 635 accommodates a second retaining lug for the outer sidewall of an adjacent first stage nozzle previously installed. As already described, a retaining ring may be divided into two semicircular sections (610, 680) that are assembled together to complete the circular retaining ring. As a result at each end 620 of a semicircular ring, only one retaining hole (615, 691) is provided.

Figure 6B:
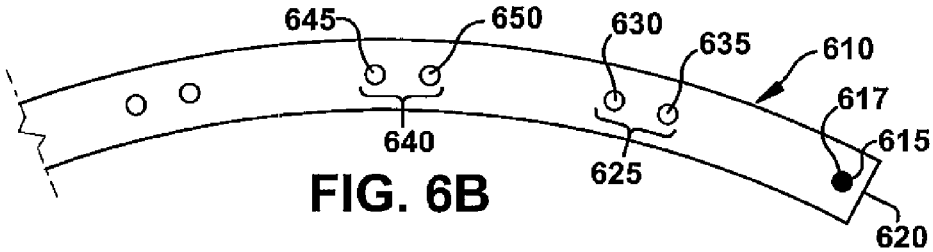
Figure 6C:
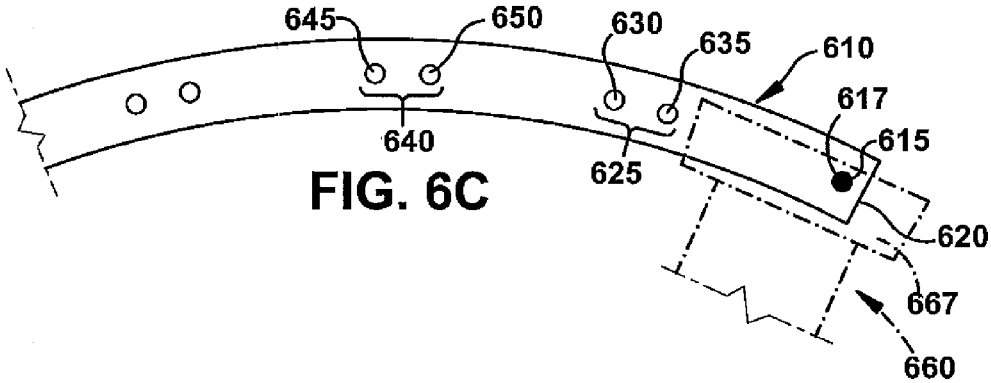
Figure 6D:
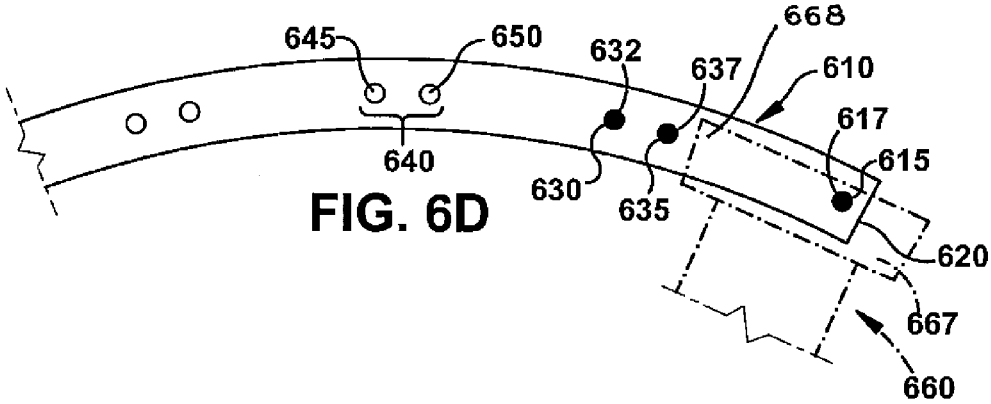

FIG. 6B illustrates a first retaining pin 617 installed in the first retaining hole 615 of retaining ring half 610 in preparation for installing a first stage nozzle. FIG. 6C illustrates the outline of a first-installed nozzle 660 placed on the retaining ring half 610. The first-installed nozzle 660 is inserted by placing a first retaining lug and a second retaining lug into an annular groove of a retaining ring and sliding the first-installed nozzle until the open slot of the first retaining lug slides over the first retaining pin 617 (retaining lugs are illustrated in FIGS. 4A-4C). Due to the skewing of the outer sidewall 665, a covering end 667 of the chordal hinge rail 660 extends clockwise past the end of the retaining ring half 610. Because the slot of the first retaining lug is open-ended, it can accept the first retaining pin 617 previously inserted into the first retaining hole even though the covering end 667 of the chordal hinge rail 660 covers the first retaining hole. FIG. 6D illustrates the second retaining pin 637 in place through the second retaining hole 635 for the hole pair 625 in the first retaining half 610. It is possible to insert the second retaining pin of the first installed first stage nozzle because a non-covering end 668 of the skewed outer sidewall leaves the second retaining hole 635 associated with the first-installed nozzle 660 uncovered. With the second retaining pin 637 for the outer sidewall of the nozzle in place, the forward and aft circumferential lands of the retaining ring lock the sidewall in place radially and circumferentially. FIG. 6D further shows first retaining pin 632 installed in first retaining hole 630 for the next-to-be-installed nozzle 670.

Figure 6E:
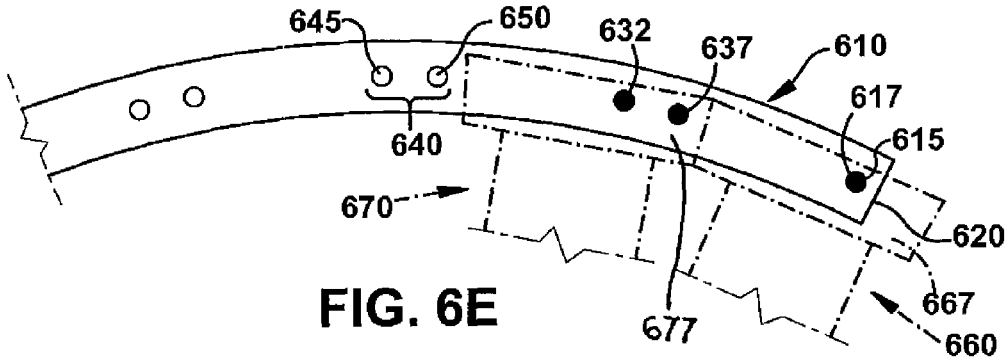

FIG. 6E illustrates an adjacent trailing nozzle 670 that has been installed on the retaining ring half adjacent to the first installed nozzle 660. Similar to the installation for the first-installed nozzle 660, the first retaining lug and the second retaining lug of the adjacent trailing nozzle are inserted into the groove between the pair of circumferential retaining lands on the retaining ring half 610. The open slot of the first retaining lug of the adjacent trailing 670 is slid over the first retaining pin. The second retaining pin 637 for the first-installed nozzle 660 and the first retaining pin 632 for the adjacent trailing nozzle 670 are now covered by the covering end 677 of the chordal hinge rail 675 for the adjacent trailing nozzle 670. The second retaining hole 650 for the adjacent trailing nozzle 670 remains uncovered.

Figure 6F:
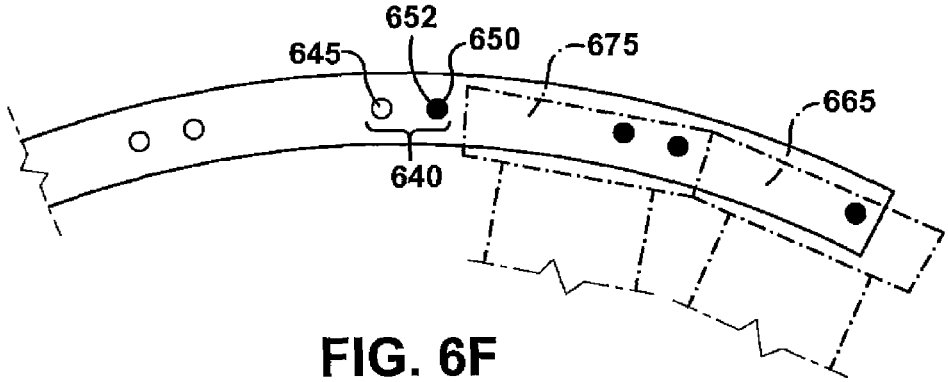

FIG. 6F illustrates placement of the second retaining pin 652 for the adjacent trailing nozzle in second retaining hole 650. With the first retaining pin 632 and the second retaining pin 652 in place, the adjacent trailing nozzle 670 is locked in place. Although not shown, additional trailing nozzles may be placed on the retaining ring half until assembly is complete.

Figure 6G:
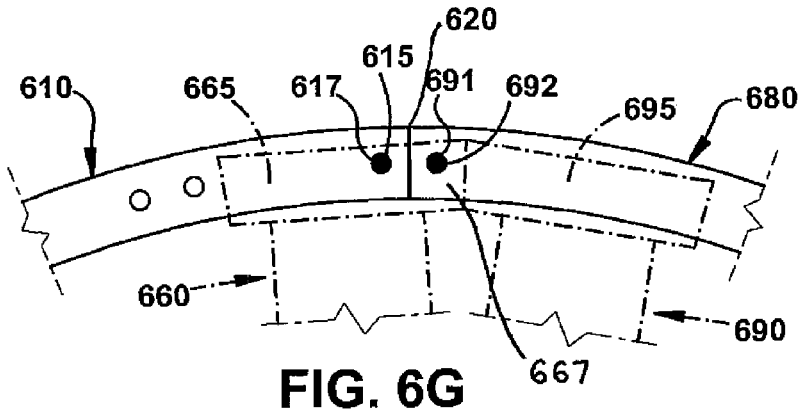

Similarly a second retaining ring half may be assembled with nozzles until full. FIG. 6G illustrates an overlap between the ends 620 for the two retaining ring halves (610, 680) (partially shown). Nozzle 660 has the covering end 667 of chordal hinge rail 665 extending beyond the end 620 of retaining ring half 610. Covering end 667 of chordal hinge rail 665 covers first retaining pin 617 for nozzle 660 and also second retaining pin 692 for nozzle 690 on retaining ring half 680. Although not shown the overlap between the other ends of retaining ring halves (610, 680) are similarly shared by the covering end of the chordal hinge rail on the outer sidewall from one retaining ring half.

While various embodiments are described herein, it will be appreciated from the specification that various combinations of elements, variations or improvements therein may be made, and are within the scope of the invention.

The invention claimed is:

1. An outer sidewall retention scheme for a first stage singlet nozzle of a gas turbine, the retention scheme comprising:

a circumferential retaining ring, the retaining ring including a main body and a pair of circumferential retaining lands projecting inward radially from the main body of the retaining ring, the pair of circumferential retaining lands being separated from each other by a predetermined distance;

a circumferential annular retaining groove between the pair of circumferential retaining lands with the groove having a width of the predetermined distance between the pair of circumferential lands;

a first stage nozzle including an inner sidewall and an outer sidewall on each nozzle;

a first lug and a second lug mounted on an outer face of the outer sidewall of each nozzle and adapted to fit within the circumferential annular retaining groove of the retaining ring;

a first retaining pin for attaching the first lug within the circumferential annular retaining groove to the pair of circumferential retaining lands and a second retaining pin for attaching the second lug within the circumferential annular retaining groove to the circumferential retaining lands;

a chordal hinge rail and chordal hinge seal on the outer sidewall for each nozzle; and a chordal hinge rail and chordal hinge seal on the inner sidewall for each nozzle.

2. The outer sidewall retention scheme for a first stage singlet nozzle according to claim 1, the retention scheme comprising: an aft retaining land of the pair of circumferential retaining lands including a plurality of axially oriented through-holes and a forward retaining land of the pair of circumferential retaining lands including a plurality of axially-oriented closed-end holes in an aft face, corresponding sets of holes in the aft retaining land and the forward retaining land being radially and circumferentially aligned.

3. The outer sidewall retention scheme according to claim 2, further comprising a plurality of radial air cooling holes through the retaining ring, wherein the plurality of radial air cooling holes interrupt the forward retaining land and divide the forward retaining land into circumferential segments.

4. The outer sidewall retention scheme according to claim 2, the outer sidewall further including a chordal hinge seal on an aft surface of the chordal hinge rail on the outer sidewall, the chordal hinge seal making contact with an opposing surface of a shroud of a first stage bucket, thereby providing axial support for the nozzle and forming a sealing path between the outer sidewall and the shroud.

5. The outer sidewall retention scheme according to claim 2, the inner sidewall further including the chordal hinge seal on an aft surface of the chordal hinge rail on the inner sidewall, the chordal hinge seal making contact with an opposing surface of a support ring, thereby providing axial support for the nozzle and sealing a path between the inner sidewall and the support ring.

6. The outer sidewall retention scheme according to claim 2, wherein:

the first lug is mounted circumferentially outboard in proximity to a pressure edge of the nozzle and mounted forward axially from an aft edge of the sidewall, the first lug further protruding outward radially from an outer face of the outer sidewall thereby being adapted to substantially fit within the circumferential annular retaining groove when the nozzle is mounted to the retaining ring; and the second lug is mounted circumferentially outboard in proximity to a suction edge of the outer sidewall and mounted forward axially from the aft edge of the outer sidewall, the second lug further protruding outward radially from the outer face of the outer sidewall thereby being substantially adapted to fit within the circumferential retaining groove when the nozzle is mounted to the retaining ring.

7. The outer sidewall retention scheme according to claim 6, wherein the first lug further comprises a slot adapted to accommodate the first retaining pin, the slot being radially and circumferentially aligned with the corresponding set of holes in the pair of circumferential retaining lands when the nozzle is positioned for mounting on the retaining ring; and the second lug further comprises a closed-hole adapted to accommodate the second retaining pin, the closed-hole being radially and circumferentially aligned with the corresponding set of holes in the pair of circumferential retaining lands when the nozzle is positioned for mounting on the retaining ring.

8. The outer sidewall retention scheme according to claim 6, wherein the first lug and the second lug are positioned circumferentially apart on the outer sidewall to the greatest extent possible.

9. The outer sidewall retention scheme according to claim 6, wherein the first lug and the second lug are positioned axially forward from the aft edge of the outer sidewall to the greatest extent possible.

10. The outer sidewall retention scheme according to claim 2, wherein the plurality of axially oriented through-holes comprise:

pairs of axial-oriented holes spaced equidistantly around a periphery of the outboard retaining ring including a first retaining hole of the pair being adapted for accepting the first retaining pin for the nozzle, and a second retaining hole of the pair being adapted for accepting the second retaining pin for an adjacent trailing nozzle.

11. The outer sidewall retention scheme according to claim 10, wherein the chordal hinge rail on the outer sidewall extends in a generally radially outward direction from an aft edge of the outer sidewall in proximity to an outer surface of the aft retaining land to at least one of partially and fully covering the pair of axial-oriented through-holes in the aft retaining land.

12. The outer sidewall retention scheme according to claim 11, wherein the the outer sidewall is skewed such that the chordal hinge rail extending in a generally circumferential direction along the aft end of the sidewall covers a portion of an aft surface of the aft retaining land, including the first retaining hole for the nozzle and the second retaining hole for an adjacent leading nozzle.

13. The outer sidewall retention scheme according to claim 11, wherein the the outer sidewall is skewed such that the chordal hinge rail extending in a generally counterclockwise circumferential direction along the aft end of the sidewall leaves uncovered a portion of the aft surface of the aft retaining land including the second retaining hole for the nozzle and the first retaining hole for an adjacent trailing nozzle.

14. The outer sidewall retention scheme according to claim 11, wherein the outer sidewall is skewed axially at approximately 23 degrees with respect to an axial direction of the retaining ring.

15. A method for retaining a first stage singlet nozzle in a first stage of a gas turbine with a first stage retaining ring including a pair of parallel circumferential retaining lands and a groove in-between, a nozzle including an outer sidewall with a first lug, a second lug and a chordal hinge rail, and an inner sidewall with a chordal hinge rail, the method comprising:

providing radial and circumferential support for the nozzle with an outer sidewall retention scheme by pinning the first lug to the pair of circumferential retaining lands and pinning the second lug to the pair of circumferential retaining lands; and providing axial support for the nozzle with the chordal hinge rail on the outer sidewall and the chordal hinge rail on the inner sidewall.

16. A method for retaining a first stage singlet nozzle according to claim 15, the step of providing radial and circumferential support further including:

positioning the first lug and second lug on the outer face of the outer sidewall in axial alignment and separated circumferentially apart as far as possible towards a respective pressure side and suction edge of the sidewall; and positioning the first retaining lug and second retaining lug on the outer face of the outer sidewall forward from the aft edge of the sidewall to the greatest extent possible.

17. The method for supporting the first stage singlet nozzle according to claim 16, the step of providing radial and circumferential support for the nozzle with an outer sidewall retention scheme by pinning further comprising:

circumferentially pairing at equal equidistant spacing around an outside face of the aft retaining land of the retaining ring a first retaining hole for a first retaining pin to support a first lug of a nozzle and a second retaining hole for a second retaining pin to support a second lug of an adjacent leading nozzle;

skewing the outer sidewall of the nozzle to orient the outer sidewall towards an adjacent leading nozzle at a predetermined angle with respect to an axial direction of the turbine; and covering the paired first retaining hole for the nozzle and the second retaining hole for the adjacent leading nozzle with the chordal hinge rail of the skewed outer sidewall, thereby providing a positive capture for the first retaining pin of the nozzle and the second retaining pin of the adjacent leading nozzle.

18. The method for supporting the first stage singlet nozzle according to claim 15, the step of providing radial and circumferential support for the nozzle with an outer sidewall retention scheme by pinning further comprising:

pinning a first retaining pin through an axial-oriented first retaining hole in an aft retaining land, through a open-sided slot in the first lug and into a closed-end hole in the forward retaining land; and pinning a second retaining pin through an axial-oriented second retaining hole in an aft retaining land, through an closed-hole in the second lug and into a closed-end hole in the forward retaining land; and transferring radial and circumferential load forces from the outer sidewall of the nozzle through the first retaining pin and the second retaining pin to the retaining ring.

19. The method for supporting the first stage singlet nozzle according to claim 15, further comprising:

inserting a first retaining pin through a first axially and circumferentially aligned hole on aft retaining land and seating the pin in the corresponding circumferentially aligned hole on the forward retaining land;

inserting the first lug into the circumferentially oriented groove;

mating the open end of the first retaining lug onto the first retaining pin;

pivoting the nozzle on the mated open end of the first retaining lug around the first retaining pin and inserting the second retaining lug of the nozzle into the circumferentially oriented groove between the pair of circumferential retaining lands;

aligning the closed-hole on the second retaining lug of the nozzle with the second axially and circumferentially aligned holes on the pair of retaining lands; and inserting the second retaining pin through the second axially and circumferentially aligned hole on the aft retaining land and the closed-hole on second retaining lug and seating the second retaining pin in the axially and circumferentially aligned hole on the forward retaining land.

20. A gas turbine employing a sidewall retention scheme for a first stage singlet nozzle, the retention scheme comprising:

a circumferential retaining ring, the retaining ring including a main body and a pair of circumferential retaining lands projecting inward radially from the main body of the retaining ring, the pair of circumferential retaining lands being separated from each other by a predetermined distance;

a circumferential annular retaining groove between the pair of circumferential retaining lands with the groove having a width of the predetermined distance between the pair of circumferential lands;

a first stage nozzle including an inner sidewall and an outer sidewall on each nozzle, the outer sidewall being skewed off an axial direction of the retaining ring;

a first lug and a second lug mounted on an outer face of the outer sidewall of each nozzle and adapted to fit within the circumferential annular retaining groove of the retaining ring;

a plurality of retaining pins, including a first retaining pin and a second retaining pin for each of the plurality of first stage nozzles, the first retaining pin for attaching the first lug within the circumferential annular retaining groove to the pair of circumferential retaining lands and a second retaining pin for attaching the second lug within the circumferential annular retaining groove to the circumferential retaining lands;

a chordal hinge rail and a chordal hinge seal on the outer sidewall for each nozzle; and a chordal hinge rail and chordal hinge seal on the inner sidewall for each nozzle.

* * * * *